US009555536B2

(12) United States Patent
Hsu

(10) Patent No.: US 9,555,536 B2
(45) Date of Patent: Jan. 31, 2017

(54) TWO-STAGE LOCKING ELECTRIC SCREWDRIVER

(71) Applicant: Hsiu-Lin Hsu, New Taipei (TW)

(72) Inventor: Hsiu-Lin Hsu, New Taipei (TW)

( * ) Notice: Subject to any disclaimer, the term of this patent is extended or adjusted under 35 U.S.C. 154(b) by 261 days.

(21) Appl. No.: 14/297,614

(22) Filed: Jun. 5, 2014

(65) Prior Publication Data

US 2015/0352698 A1 Dec. 10, 2015

(51) Int. Cl.
*B25B 21/00* (2006.01)
*B25F 5/00* (2006.01)
*B25B 23/14* (2006.01)

(52) U.S. Cl.
CPC ..... *B25F 5/001* (2013.01); *B25B 21/008* (2013.01); *B25B 23/141* (2013.01)

(58) Field of Classification Search
CPC ..... B25F 5/001; B25B 23/141; B25B 21/008
See application file for complete search history.

(56) References Cited

U.S. PATENT DOCUMENTS 4,215,594 A * 8/1980 Workman, Jr. ..... B25B 21/008 173/178
4,650,007 A * 3/1987 Fujita ..... B25B 21/008 173/178
4,834,192 A * 5/1989 Hansson ..... B25B 21/008 173/178
4,881,435 A * 11/1989 Hansson ..... B23P 19/065 173/178
4,892,013 A * 1/1990 Satoh ..... B25B 21/008 173/178
4,908,926 A * 3/1990 Takeshima ..... B25B 21/008 173/181
5,203,242 A * 4/1993 Hansson ..... B25B 21/008 81/469
7,112,934 B2 * 9/2006 Gilmore ..... B23P 19/066 318/432
7,334,646 B2 * 2/2008 Hara ..... B25F 5/001 173/176
7,334,647 B2 * 2/2008 Hahn ..... B25B 23/141 173/178
7,513,845 B2 * 4/2009 Ho ..... B25B 21/008 173/216
7,591,326 B2 * 9/2009 Ikuta ..... B23B 45/008 173/170

(Continued)

*Primary Examiner* — David B Thomas
(74) *Attorney, Agent, or Firm* — Alexander Chen

(57) ABSTRACT

A two-stage locking electric screwdriver, with its main improved features as follow: the electric screwdriver has pre-locking and locking functions; the torque settings of the electric screwdriver can be easily modulated, and meanwhile the torque accuracy and energy efficiency can be improved; the torque modulation type is external modulation, so that the torque modulation can be carried out externally and even the torsion spring can be replaced. Meanwhile, the component structures inside the electric screwdriver is improved through a design that the motor directly drives the clutch and then drive the screwdriver head unit, and that an internal gear clutch is used to replaced the gear unit and clutch unit, so that the number of parts is dramatically reduced to save production cost. During general rotation, the electric screwdriver will not drive the clutch unit, and when the torque jumps to the set value, the internal gear clutch rotates and generates a torque.

7 Claims, 13 Drawing Sheets

(56) References Cited

U.S. PATENT DOCUMENTS 7,665,392 B2 * 2/2010 Tokunaga ..... B25B 21/00 173/178
7,882,899 B2 * 2/2011 Borinato ..... B23B 45/008 173/176
7,882,900 B2 * 2/2011 Borinato ..... B23B 45/008 173/176
8,303,449 B2 * 11/2012 Ho ..... B23B 45/008 173/176
8,469,115 B2 * 6/2013 Kondo ..... B25B 21/00 173/178
8,607,891 B2 * 12/2013 Kondo ..... B25B 21/008 173/176
8,746,364 B2 * 6/2014 Atsumi ..... B25F 5/001 173/176
8,851,201 B2 * 10/2014 Limberg ..... F16D 7/044 173/178
8,944,179 B2 * 2/2015 Ukai ..... B25B 21/008 173/178
9,004,192 B2 * 4/2015 Ito ..... B25B 21/008 173/176
9,233,457 B2 * 1/2016 Wanek ..... B25B 21/00
2006/0211534 A1 * 9/2006 Roberts ..... B25B 21/00 475/317
2006/0278417 A1 * 12/2006 Hahn ..... B25B 23/141 173/178
2009/0098971 A1 * 4/2009 Ho ..... B23B 45/008 475/153
2009/0277658 A1 * 11/2009 Chen ..... B23B 45/008 173/183
2011/0162861 A1 * 7/2011 Borinato ..... B23B 45/008 173/176
2011/0186320 A1 * 8/2011 Ito ..... B25B 21/008 173/176
2014/0166326 A1 * 6/2014 Le Du ..... B25B 21/02 173/181
2015/0041164 A1 * 2/2015 Sergyeyenko ..... B25B 21/008 173/1

* cited by examiner (A) (B)

TWO-STAGE LOCKING ELECTRIC SCREWDRIVER

BACKGROUND OF INVENTION

1. Field of the Invention

The present invention relates generally to an innovative electric screwdriver, and more particularly to a two-stage locking electric screwdriver with external torque modulation, featuring convenient modulation, accurate torque, lower power consumption and minimal number of parts.

2. Description of Related Art

The technique of screw (bolt) locking is playing a significant role in various industrial fields and modern technologies. The screw (bolt) assembly technique is particularly important in the automobile, aerospace and bolt manufacturing fields SCHATZ is a company with more than 50 years of technical experience and has long been engaged in the development of solutions for assembly and quality assurance of various bolts. The company has set a benchmark for the industry, and its technological level has become national or even international standards and guidelines; Doctor Volker Schatz authored a book named 10 *Steps for Reliable Bolted Assembly*, which described in detail 10 steps affecting all factors in the process of assembly, and analyzed the causal relationship affecting the bolt connecting and fastening quality. These 10 steps can be made into a step-by-step examination chart to monitor perfectness of the methods utilized during the process of bolt connecting and fastening Of course, these 10 steps can also be used in formulating guidelines reflecting state-of-the-art quality control systems and standards. Based on the guide of this book, the locking quality assurance can be enhanced to the top level meeting all current standards and methods.

In this book, there is a description that: in terms of threaded bolt fastening, the tightening method is the most important aspect in the assembly strategy. Each bolt fastening operation to assemble the components shall have a guideline to indicate the fastening steps and the measurement data to be used. For this purpose, the parameters for each assembly step shall be calculated based on an abstract model. Due to the abstract model, these parameters are only an approximation of real conditions. The assumptions and estimations provided here can be used as the basis for the design of fastener connection. On the other hand, during actual assembly operations, those charts, standards and testing results often cannot reflect the factors influencing the assembly, while the results are often used as the basis for the assembly operations. In current fastening standards adopted in the production process, there is usually a specified torque with an appropriate tolerance range, or an indication to use the Turn-of-nut Installation Method to tighten the fastener, i.e., rotating the fastener to a certain angle to reach the preset torque. The bolt connecting and fastening process is seemingly very simple. When using a tool with rotating power for fastening, the bolt is screwed into the screw hole. Not until the screw head touches the assembled piece will the twisting tool suddenly stop rotation. During this process, most of the time is used to screw in the fastener. In actual assembly, i.e., binding two or more parts together, this action is instantly finished through frictional force within 1 second.

Just because the locking assembly process is finished in a very short time, in the locking operation to bind elastic materials, defects are almost unavoidable. As shown in FIG. 1, when the fastener is instantly locked, an elastic deformation occurs. When the elastic material has a plastic deformation, like a spring, even though the screw (bolt) is locked within its elastic limit, it may also cause looseness of the locking, i.e., loss of the so-called clamping force.

Further referring to FIG. 2, the multi-functional bolt fastening analysis system in the German Schatz Laboratory analyzed the performance of the screw (bolt) based on different locking objects. FIG. 2 (A) depicts the performance of the bolt when locking a material thinner than the length of the bolt. FIG. 2 (B) depicts the perforce of the bolt when installed on a material thicker than the length of the bolt.

Based on the descriptions, the above FIG. 2 (B) means that, when the screw (bolt) is rotated in a very instant torque to reach the locking status, even if the torque is maintained within the tolerance range, the locking operation is actually incomplete and the screw (bolt) is not properly installed. On the other hand, FIG. 2 (A) means that, in the case of a two-stage locking, the situation occurred in FIG. 2 (B) can be avoided, and the screw (bolt) locking is properly installed and completely tightened.

Conventional electric screwdrivers can be divided into internal torque modulation and external torque modulation. Referring to FIG. 3 for internal torque modulation, the torsion spring is configured inside (i.e., between the coupling shaft and the torque tube), and is enclosed by a torque sheath. In the operation to modulate the torque, as the torsion spring is located inside the structure, a specially designed torque wrench (or tool) must be used to turn a specific angle to adjust the torque. Once the special wrench (or tool) gets lost, the torque can no longer be adjusted; Although the internal torque modulation is not easily realized, it has such an advantage that: when the motor is started, the no-load current will not be affected by the torque of the clutch. Hence, it is energy-efficient.

Secondary, in the case of external torque modulation, the torsion spring is also configured inside, but there is an external torque modulating ring (mostly commonly seen in the market). In operation, it can be directly modulated by hand and is therefore very convenient; but the shortcoming is: when the motor is started, the no-load current will vary depending on the modulated torque. Hence it consumes more power.

Furthermore, apart from the motor, an ordinary electric screwdriver at least includes a gear unit, a clutch unit and a screwdriver head unit. In either internal torque modulation or external torque modulation, when the screwdriver is started, the motor drives the gear unit, and the gear unit drives the clutch unit and screwdriver head unit to operate. This will increase the rotational weight and will consume more power.

SUMMARY OF THE INVENTION

The primary objective of the present invention is to provide a two-stage locking electric screwdriver, which, based on the design of an internal gear clutch with staggered internal teeth and interlaced cams, the inner ring orbit of the cam can firstly provide a torque for pre-locking, and during operation, when the cams on the inner and outer ring orbits interlace, a maximum torque will be generated for a perfect locking effect.

The second objective of the present invention is to provide a two-stage locking electric screwdriver, through which the torque can be directly modulated and the torsion spring can be replaced timely to substantially enhance the torque accuracy.

The third objective of the present invention is to provide a two-stage locking electric screwdriver, so as to dramatically reduce the number of parts to produce the electric screwdriver, and to reduce production cost and save power.

To realize the above objectives, the inventor of the present invention designed a totally new two-stage locking electric screwdriver. The electric screwdriver has a matching external enclosure, and inside the enclosure, it at least includes: a motor unit, to provide power source; a clutch unit, coupled with and driven by the motor, the clutch unit has power transmission and speed shifting functions, and can provide two-stage torque output; a screwdriver head unit, driven by the clutch unit, and can be fitted with various screwdriver heads; a trigger unit, to control the starting of the motor of the electric screwdriver, and meanwhile has a function to avoid button reset; and a controller unit, with a built-in micro-controller unit (MCU) panel, and a power source to supply required power.

Said motor unit further includes: a motor, an accelerator/supercharger, and the spin axis for motor power output has an accelerator/supercharger going through it.

Said motor is preferentially a brushless motor.

Said accelerator/supercharger includes one or more than one bearing (or sleeve) with certain proportional weight and is made of metallic material.

Said clutch unit further includes: an internal gear clutch, a lower clutch, a coupling shaft, a torque tube, a torsion spring, and a torque sheath; the internal gear clutch is in the form of a planetary gear, with one side bound with a gear and a gear disc, and coupled with and driven by the spin axis of the motor, and with the other side configured with a pair of interlaced (inner and outer ring) planetary orbits, and with design of cam surface on the planetary orbits formed by interlaced projecting portions. Steel balls are provided on the pair of planetary orbits. The cam surfaces of the lower clutch and the internal gear clutch contact each other. The coupling shaft goes through the lower clutch and one of its ends is linked to and moves along with the planetary gear of the internal gear clutch. The other end of the coupling shaft is provided with a torque tube, and the torque tube has a going-through torsion spring, and is further covered by a torque sheath.

Said screwdriver head unit has an inside connecting shaft, linked with and moving along with the coupling shaft inside the clutch unit. The connecting shaft has a binding cleft to fit various screwdriver heads, with three steel balls inside the cleft for clamping and positioning.

The inside shape of said binding cleft can be of any geometric shape, such as round, square or polygon.

Said power source can be a rechargeable battery.

Said electric screwdriver further includes a torque adjusting wrench.

Although the invention has been explained in relation to its preferred embodiment, it is to be understood that many other possible modifications and variations can be made without departing from the spirit and scope of the invention as hereinafter claimed.

BRIEF DESCRIPTION OF THE DRAWINGS

FIG. 5 (A) is the Operational Drawing (I) of the internal gear clutch of a preferred embodiment of the present invention.

FIG. 5 (B) is the Operational Drawing (II) of the internal gear clutch of a preferred embodiment of the present invention.

FIG. 5 (C) is the Operational Drawing (III) of the internal gear clutch of a preferred embodiment of the present invention.

FIG. 5 (D) is the Operational Drawing (IV) of the internal gear clutch of a preferred embodiment of the present invention.

FIG. 5 (E) is the Operational Drawing (V) of the internal gear clutch of a preferred embodiment of the present invention.

DETAILED DESCRIPTION OF THE INVENTION

Figure 1:
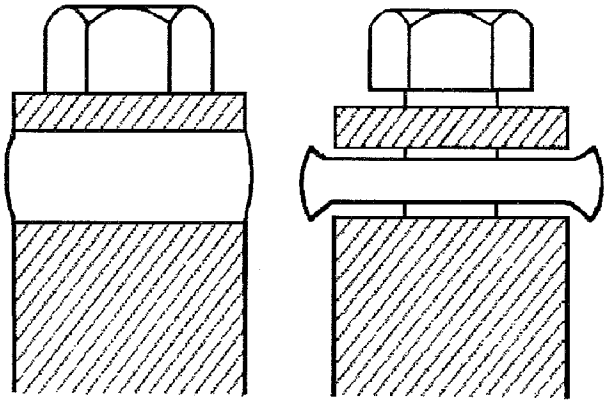
FIG. 1 is a schematic drawing of an existing screw (bolt) locking an elastic material.
Figure 2:
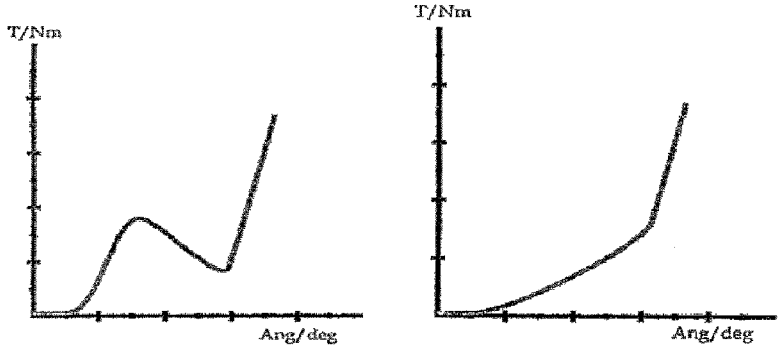
FIG. 2 is a schematic drawing depicting the performance of an existing screw (bolt) locking a material where (A) the material is thinner and (B) the material is thicker than the length of the screw (bolt).
Figure 3:
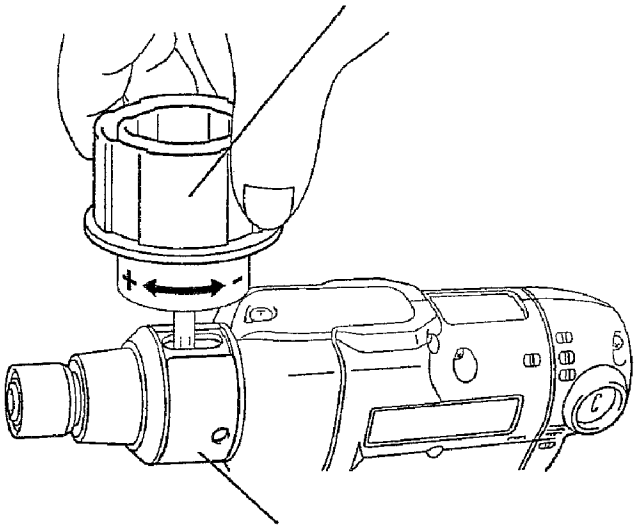
FIG. 3 is a schematic drawing depicting the torque modulation of an existing internal torque modulation electric screwdriver.
Figure 4:
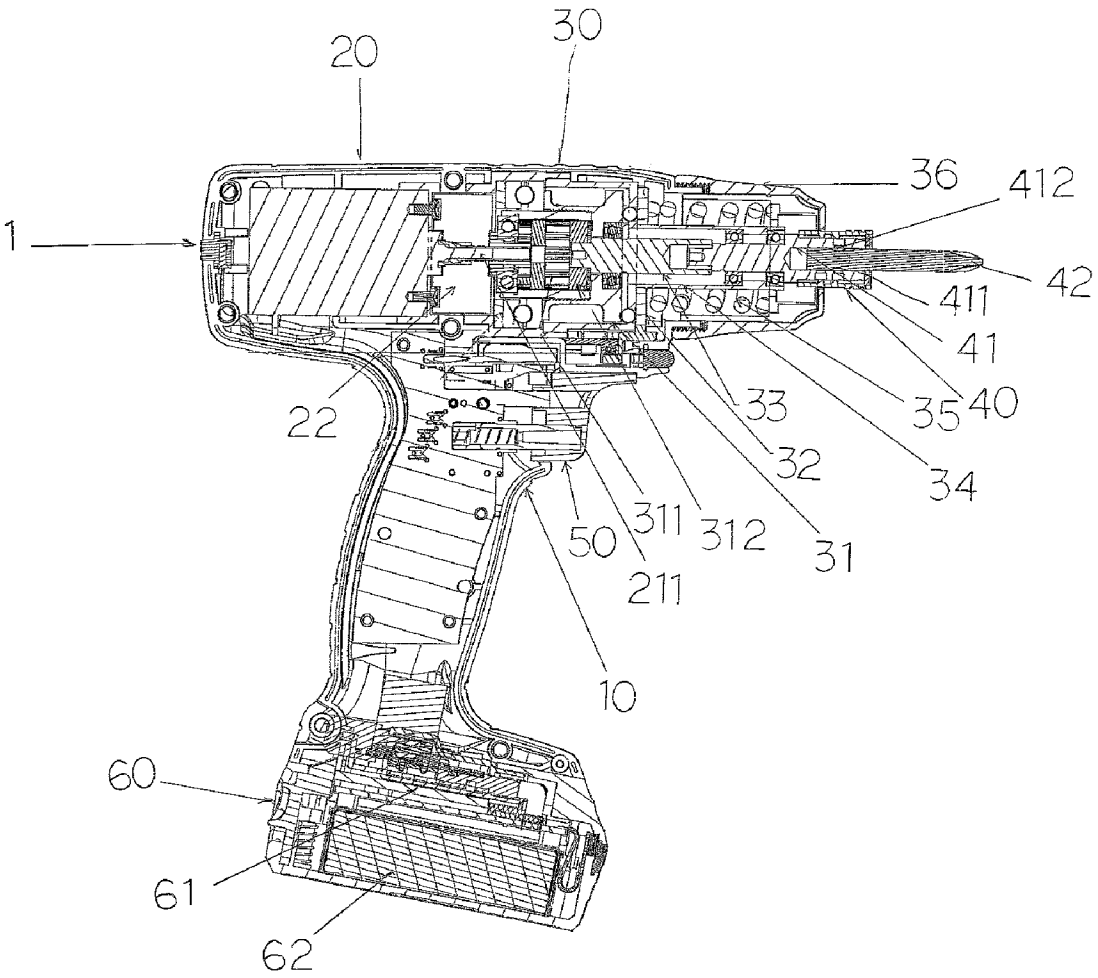
FIG. 4 is a structural drawing the electric screwdriver of a preferred embodiment of the present invention.

The electric screwdriver 1 is rechargeable, with a matching external enclosure 10. The enclosure 10 can be in any type, such as upright type, or gun type etc. The present embodiment takes the gun type as an example. Inside the enclosure 10, there are at least configurations including: a motor unit 20, an internal gear clutch unit 30, a screwdriver head unit 40, a trigger unit 50 and a controller unit 60.

The motor unit 20 further includes: a motor 21, an accelerator/supercharger 22. The motor 21 is preferably but not limited to a brushless motor, and the power outputting spin axis 211 has a going-through accelerator/supercharger 22, which includes one or more than one bearing (or sleeve) with certain proportional weight and is made of metallic material; in actual application, the accelerator/supercharger 22 is configured on the power outputting spin axis 211 of the motor 21, for the effect of slow start and accelerated running. With this, the power of the motor can be doubled with minimal electricity consumption. Consequently, the time used to lock the screw can be shortened and working efficiency improved.

Figure 5:
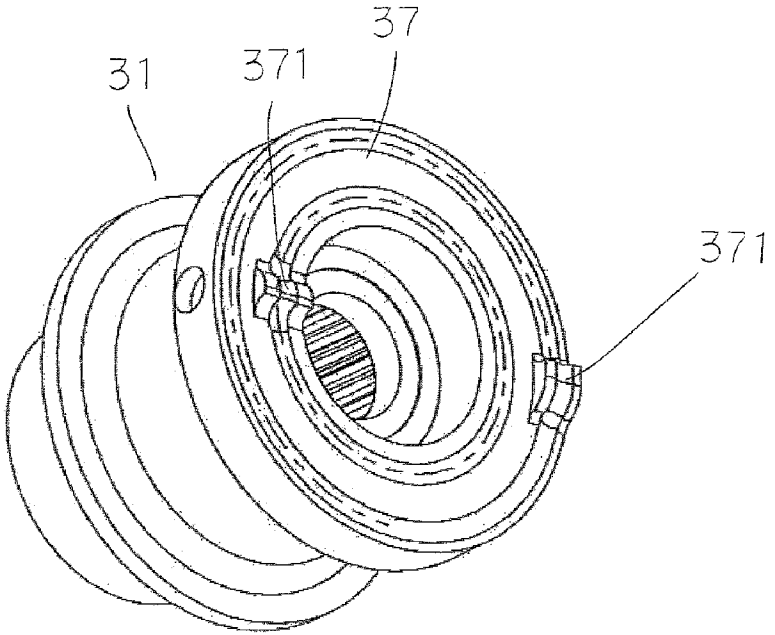
FIG. 5 is a structural drawing of the internal gear clutch of a preferred embodiment of the present invention.
Figure 5:
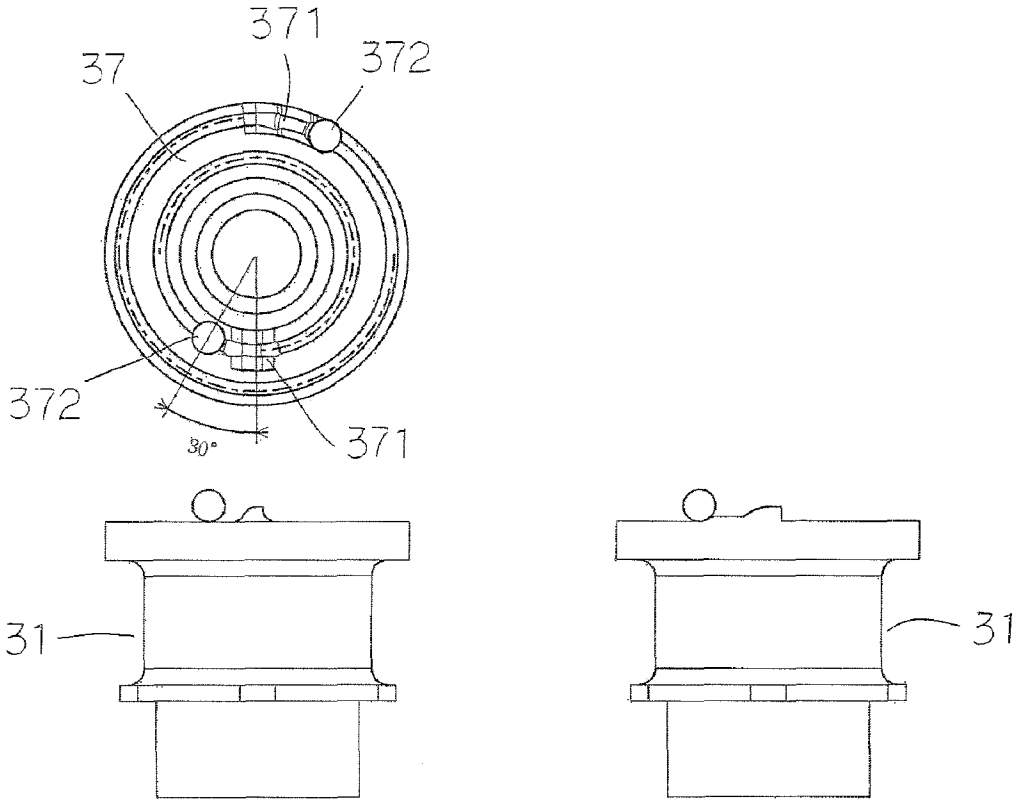
Figure 5:
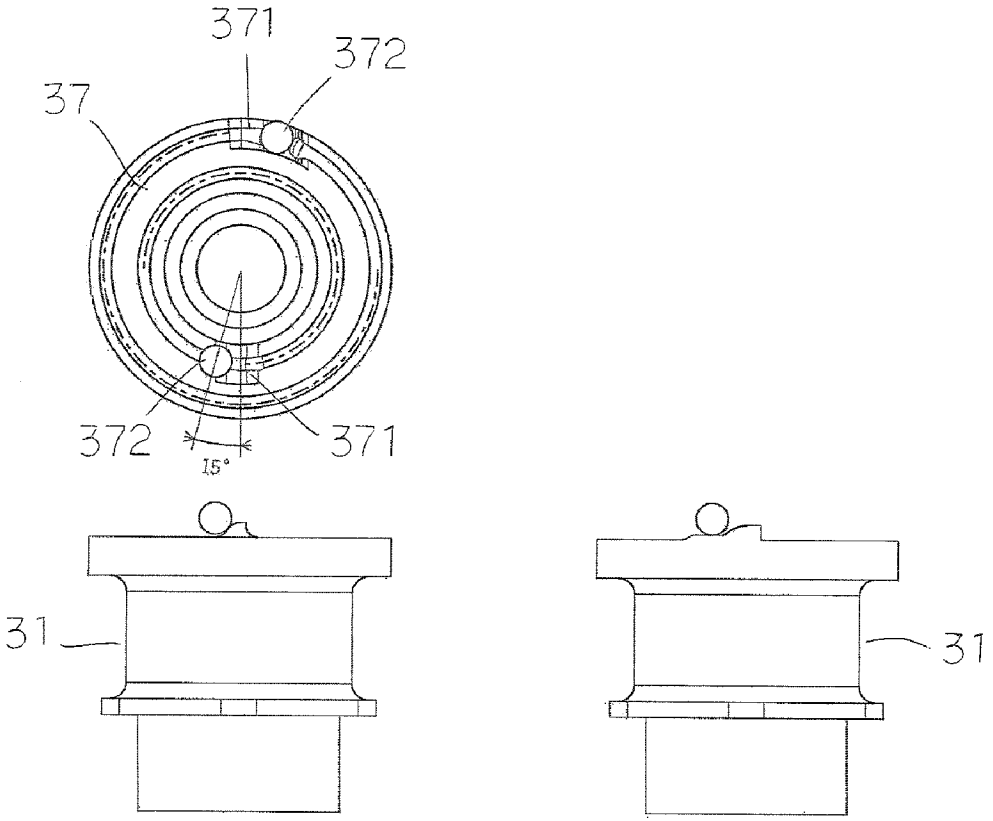
Figure 5:
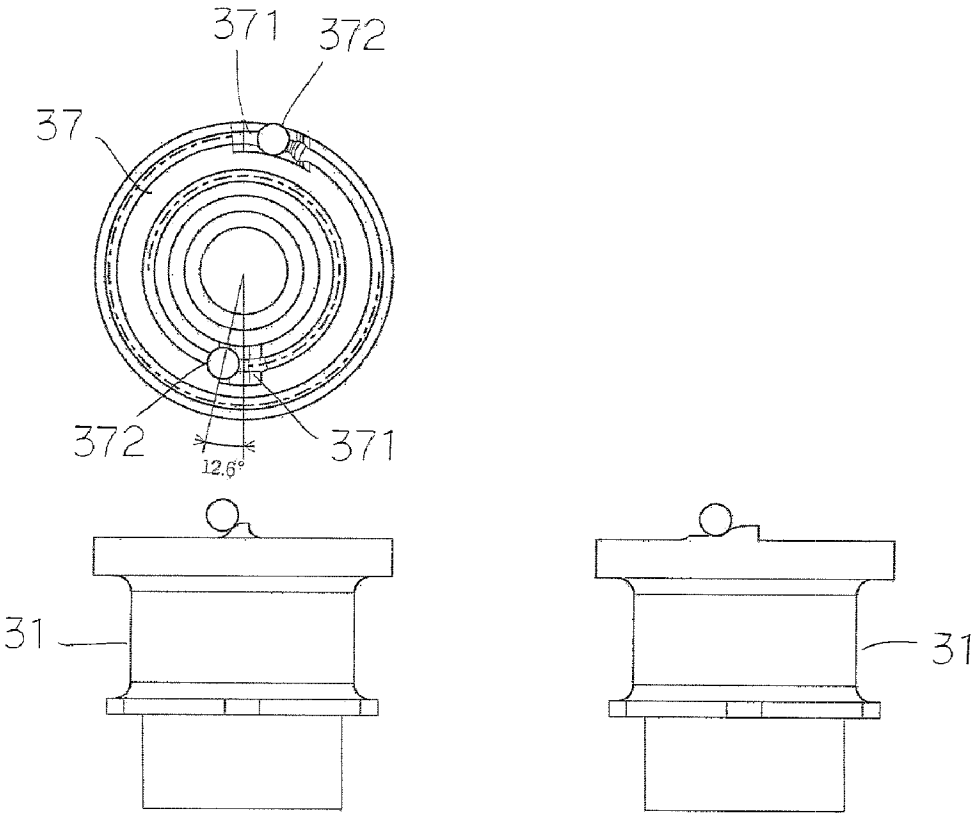
Figure 5:
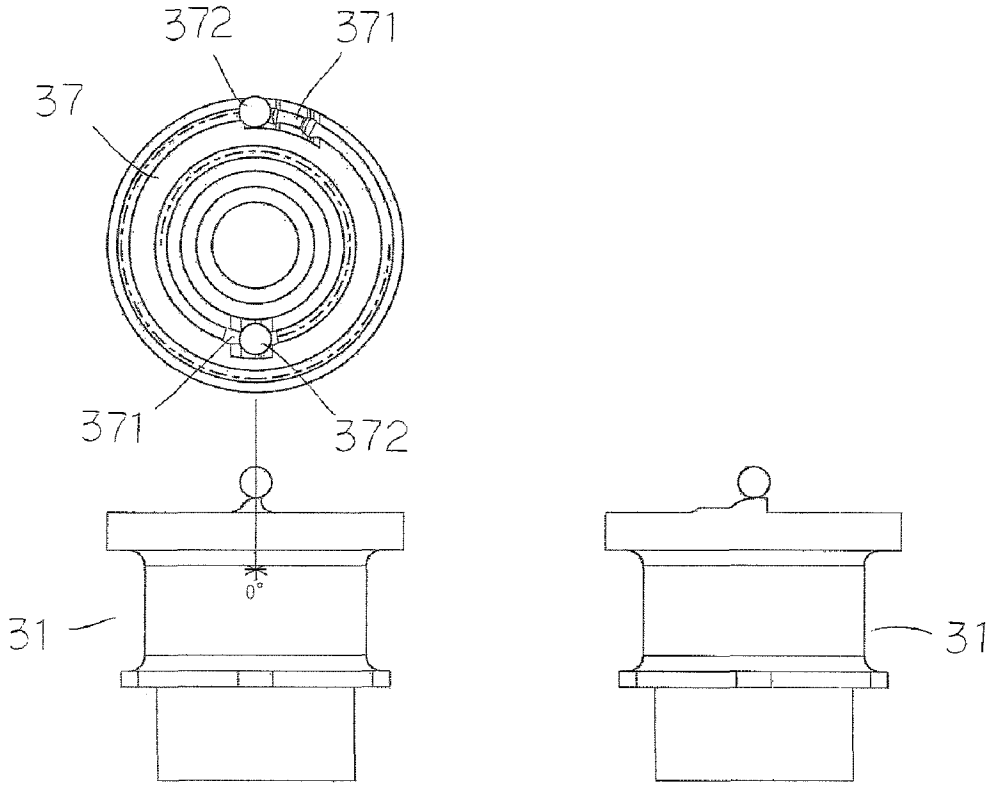
Figure 5:
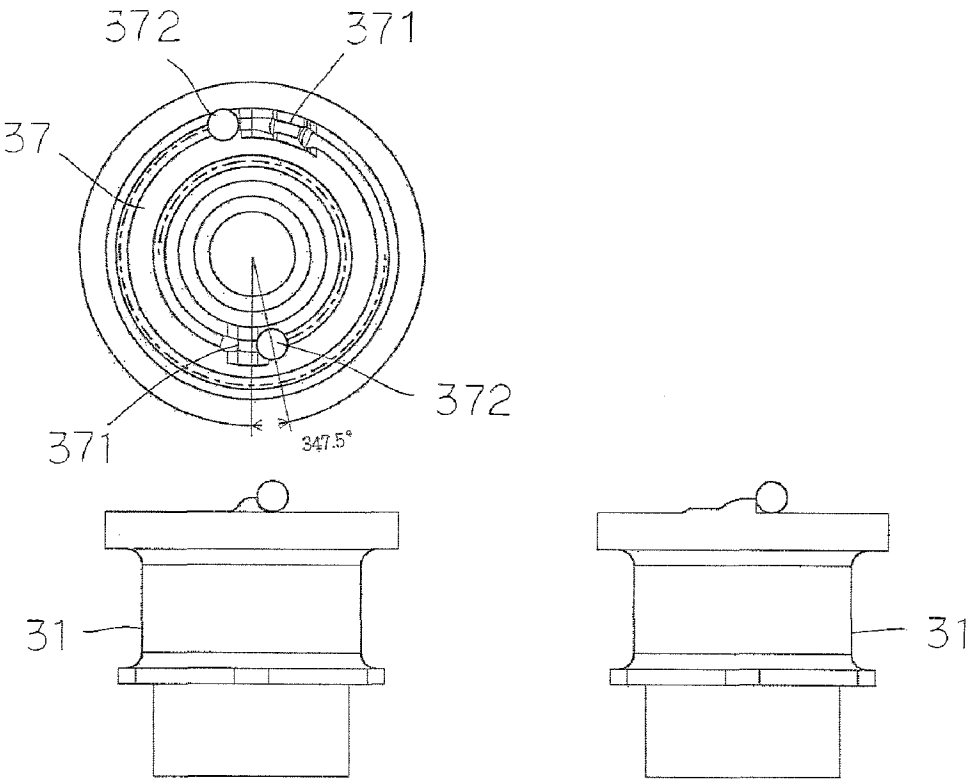

The clutch unit 30 further includes: an internal gear clutch 31, a lower clutch 32, a coupling shaft 33, a torque tube 34, a torsion spring 35, and a torque sheath 36; Referring to FIG. 5, the internal gear clutch 31 is in the form of a planetary gear, with one side bound with a gear 311 and a gear disc (312), and coupled with and driven by the spin axis of the motor 21, and with the other side configured with a pair of interlaced (inner and outer ring) planetary orbits, and with design of cam surface on the planetary orbits formed by interlaced projecting portions 371. Steel balls 372 are provided on the pair of planetary orbits. The cam surfaces of the lower clutch 32 and the internal gear clutch 31 contact each other. The coupling shaft 33 goes through the lower clutch 32 and one of its ends is linked to and moves along with the planetary gear of the internal gear clutch 31. Based on this, the power transmission and speed changing of the motor 21 can be improved. The other end of the coupling shaft 33 is provided with a torque tube 34, and the torque tube 34 has a going-through torsion spring 35, and is further covered by a torque sheath 36. Based on this, the required torque value can be set, and the user can freely modulate the torque value as needed after removing the torque sheath 36, or even replace the torsion spring 35 to enhance the screw locking precision and quality.

The cam surface 37 of the internal gear clutch 31 is depicted in FIG. 5. The cam surface 37 has inner and outer ring planetary orbits, and the inner and outer ring orbits are configured on appropriate positions with: two corresponding projecting portions 371, respectively contacting the edges of the inner and outer ring planetary orbits, and the two projecting portions 371 have different shapes, and two steel balls 372, respectively circulating on the inner and outer ring planetary orbits without affecting each other.

The screwdriver head unit 40 has a connecting shaft 41 configured inside, which is axially linked with and moves along with the coupling shaft 33 inside the clutch unit 30; The connecting shaft 41 mainly has a binding cleft 411 for various screwdriver heads 42 to be inserted into. The inside shape of the binding cleft 411 can be in any geometric shape to match the connecting end shapes of existing common screwdriver heads, such as round, square, polygon etc, with no limit. Inside the cleft, three steel balls 412 are provided for clamping and positioning, so that the screwdriver head 42 can be synchronously and stably fixed.

The trigger unit 50 is to control the start of the electric screwdriver 1, and meanwhile has a function to avoid button reset.

The controller unit 60, with a built-in micro-controller unit (MCU) panel 61, and a power source 62 to supply required power. In the present embodiment, a rechargeable battery is adopted, but the power source is not limited to this.

In operation of the electric screwdriver of the present invention as described above, when the motor 21 is started, the internal gear clutch 31 will rotate, and drive the screwdriver 42 to rotate; on the cam surface of the internal gear clutch 31, the steel ball 372 located on the inner ring planetary orbit and its projecting portion 371 will jump to generate a torque. At this time, it is torque value for the pre-locking function; Then, the rotation will continue, and when steel balls 372 and the corresponding projecting portions 371 on the inner and outer ring planetary orbit jump at the same time, a maximum torque will be generated, to further tighten the screw and reach the expected standard value; In this way, the whole locking effect and quality will be perfect.

Referring to FIG. 5 (A)~(E), depicting the respective actions of the cam surface 37 and two steel balls 372 of the internal gear clutch 31; wherein the two projecting portions 371 respectively configured on the inner and outer ring planetary orbits have upper dead point and lower dead point to constitute continuous stroke cycles. The stroke cycle at least includes the following stroke stages: FIG. 5 (A) depicts the first stroke, to control the torque of the electric screwdriver, with an outer R angle design, here, the steel ball 372 on the outer ring has entered into the outer R angle of the projecting portion 371 on the outer ring; FIG. 5 (B) depicts the second stroke, for the pre-locking function, here, the steel ball 372 on the outer ring has been pushed into a horizontal stroke, and meanwhile the steel ball 372 on the inner ring has entered into the outer R angle of the projecting portion 371 on the inner ring, and at this time a torque value is obtained; FIG. 5 (C) depicts the third stroke, here the steel ball 372 on the outer ring has traveled to the end of the parallel, while the steel ball 371 on the inner ring continues to climb the projecting portion 371 on the inner ring; FIG. 5 (D) depicts the fourth stroke, here the steel balls 372 on the inner and outer rings have both climbed to the highest upper dead points of the projecting portions 371, at this time, a maximum torque value is generated; FIG. 5 (E) depicts the fifth stroke, the steel ball 372 on the outer ring quickly falls to the highest lower dead point, and meanwhile the steel ball 372 on the inner ring slowly falls to the highest lower dead point, and the locking is completed by now.

In case there is a need for a different rotational speed, pre-locking torque or maximum torque, the corresponding angles of the two projecting portions can be altered. As shown in FIG. 5, the two projecting portions 371 on the inner and outer ring planetary orbits are positioned on the same diameter line, if the angle of the projecting portion 371 on the inner ring is offset clockwise, the included angle with the projecting portion 371 on the outer ring will be reduced, and the rotational speed will slow down; if the angle of the projecting portion 372 on the inner ring is offset counter-clockwise, the included angle with the projecting portion 371 on the outer ring will be enlarged, and the rotational speed will speed up; This design will meet diversified locking needs.

Figure 6:
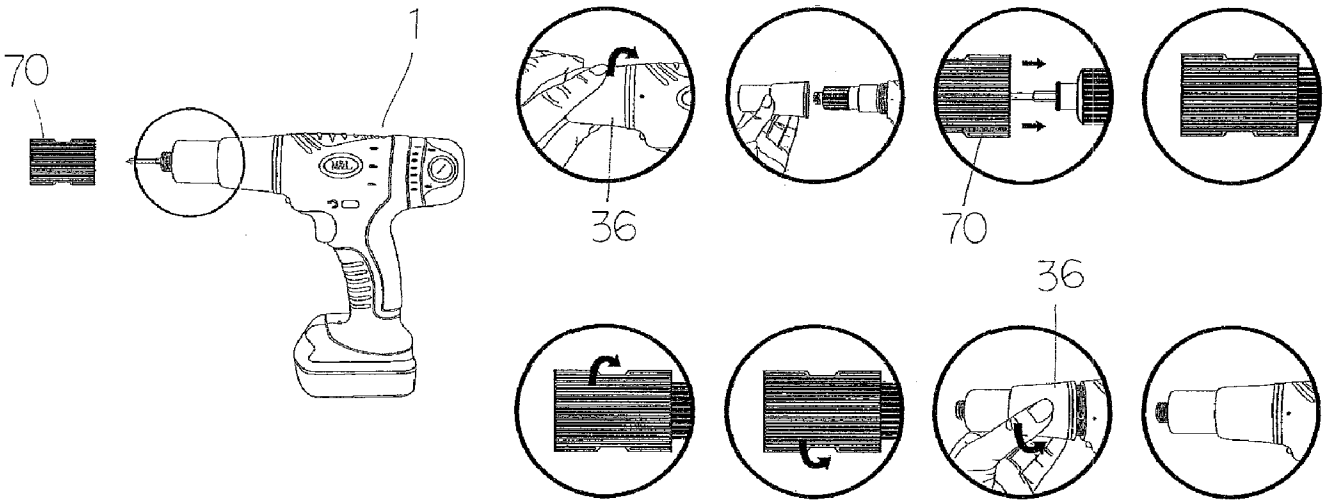
FIG. 6 is a schematic drawing of the torque modulation of a preferred embodiment of the present invention.

Further referring to FIG. 6, the operational processes of torque modulation of the electric screwdriver of the present invention are as follow: loosen and take down the torque sheath 36, gently push in the torque adjusting wrench 70, rotate the torque adjusting wrench 70 clockwise to increase the torque, or counter-clockwise to reduce the torque, as required, after the modulation is completed, take out the torque adjusting wrench 70, and at last screw in the torque sheath 36, and make sure it is back to the original correct position.

As stated above, the electric screwdriver of the present invention is an external torque modulation type, and its torque modulation can be easily operated. Comparing to existing internal torque modulation types, it is more advanced and has better torque accuracy.

Moreover, because of the unique design of its clutch unit and internal gear unit, the electric screwdriver of the present invention is made up of less number of parts when comparing to existing electric screwdrivers with a gear unit and a clutch unit, and therefore it will help reduce manufacturing cost and speed up assembly; Meanwhile, due to the reduced number of parts, when using the electric screwdriver, the reduced rotational weight can help the motor to drive the screwdriver more easily, and save electricity.

Figure 7:
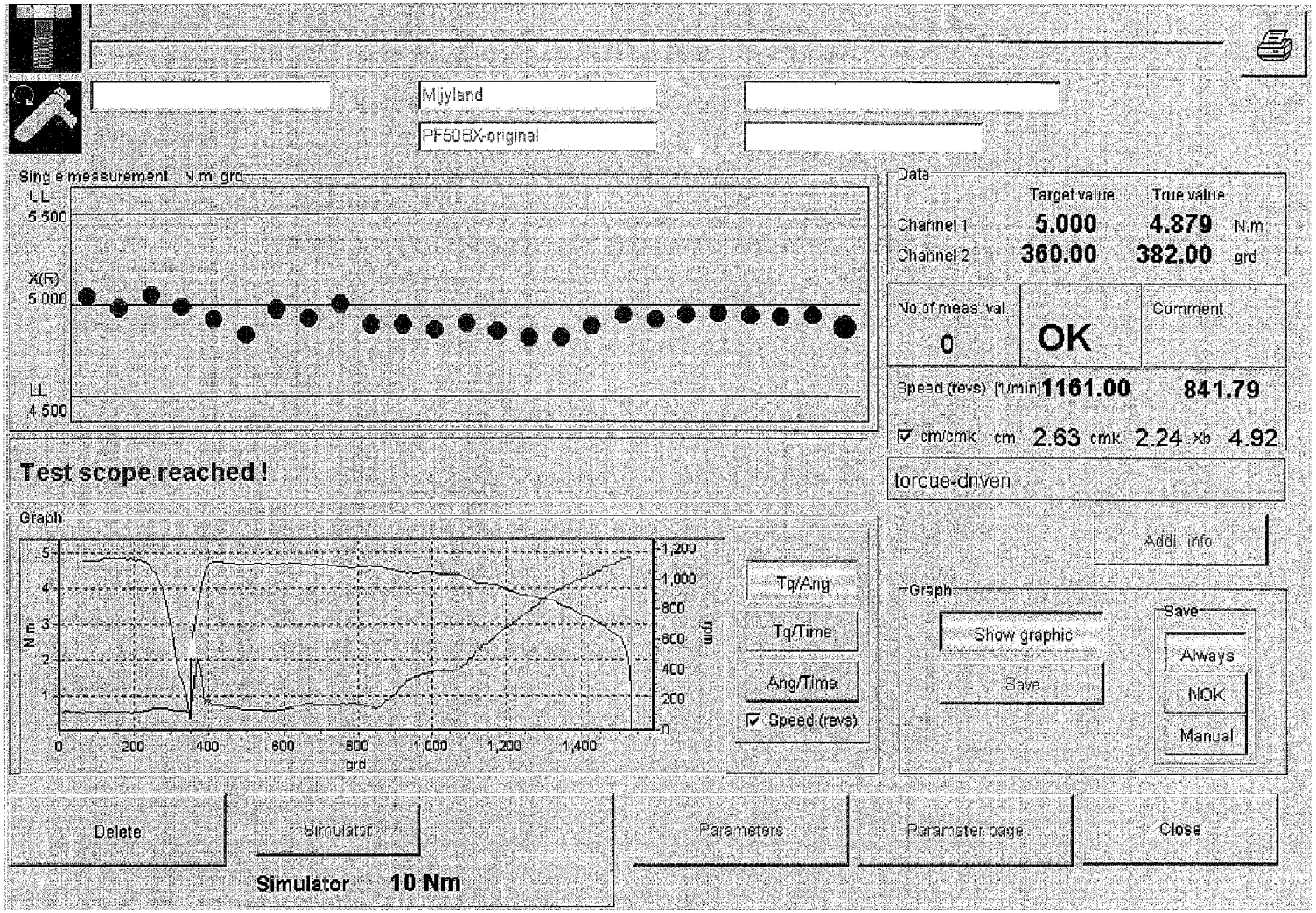
FIG. 7 is a schematic view depicting the actual locking performance of the electric screwdriver of the present invention displayed on a dynamic torque testing machine.
Figure 8:
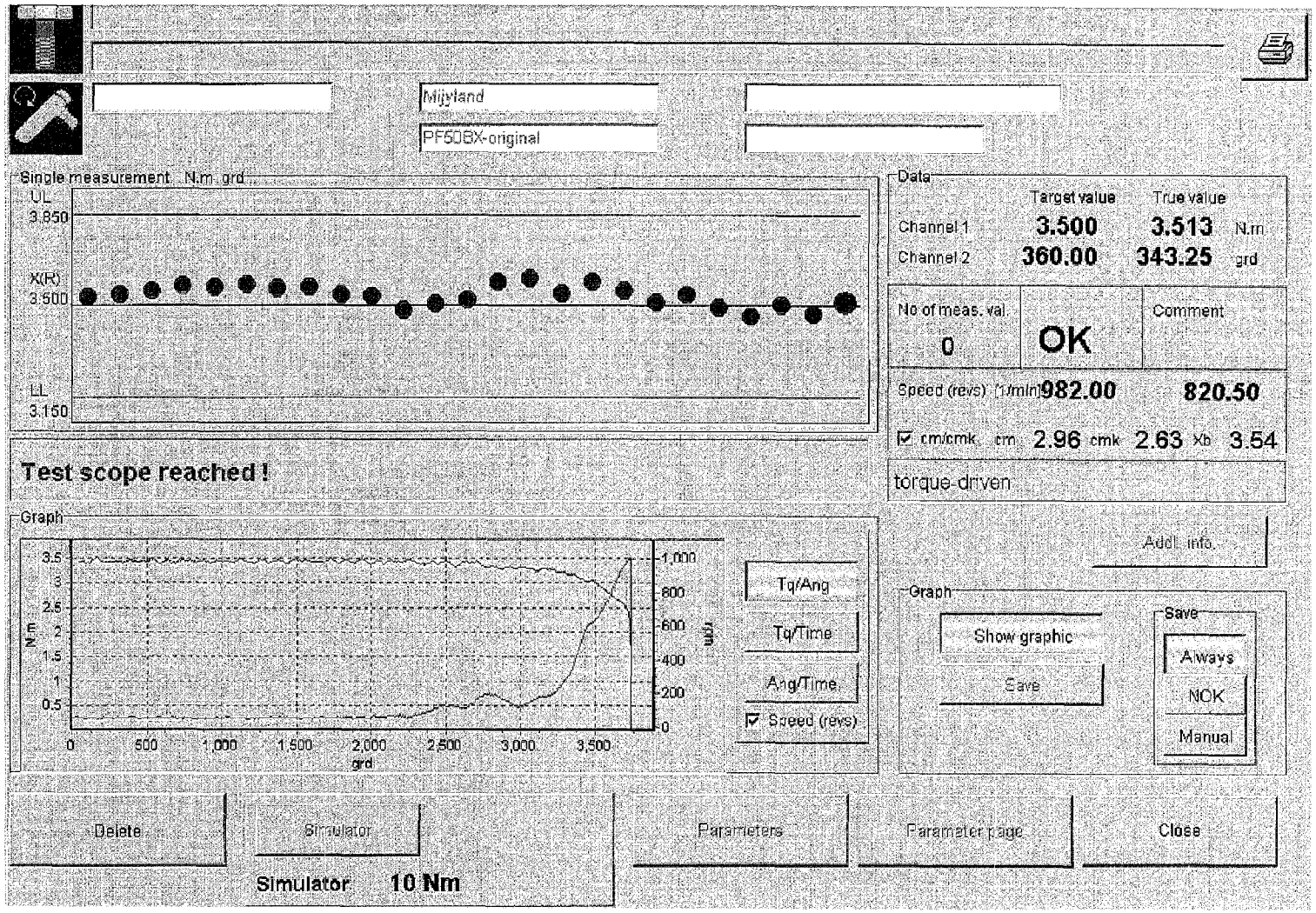
FIG. 8 is a schematic view depicting the actual locking performance of an ordinary electric screwdriver displayed on a dynamic torque testing machine.

Referring to FIGS. 7 and 8 as a whole, wherein FIG. 8 is a reflection of the locking process of an ordinary electric screwdriver on a dynamic torque testing machine, it can be clearly seen that the locking process is very simple and lasts till the tight status; while FIG. 7 is a reflection of the two-stage locking electric screwdriver of the present invention, and clearly shows that the process is made up of a first stage locking (i.e., pre-locking) and a second stage locking. This indicates that the two-stage locking process reflected by the dynamic torque testing machine right corresponds to the so-called perfect locking defined by Schatz in his book.

The invention claimed is:

1. A two-stage locking electric screwdriver comprises a matching external enclosure, and inside the enclosure there are at least:

a motor unit, to provide power source;

a clutch unit, coupled with and driven by the motor, the clutch unit has power transmission and speed shifting functions, and can provide two-stage torque output;

a screwdriver head unit, driven by the clutch unit, and can be fitted with various screwdriver heads;

a trigger unit, to control the starting of the motor of the electric screwdriver, and meanwhile has a function to avoid button reset; and a controller unit, with a built-in micro-controller unit (MCU) panel, and a power source to supply required power; wherein said clutch unit further includes: an internal gear clutch, a lower clutch, a coupling shaft, a torque tube, a torsion spring, and a torque sheath; the internal gear clutch is in the form of a planetary gear, with one side bound with a gear and a gear disc, and coupled with and driven by the spin axis of the motor, and with the other side configured with a pair of interlaced (inner and outer ring) planetary orbits, and with design of cam surface on the planetary orbits formed by interlaced projecting portions; steel balls are provided on the pair of planetary orbits; the cam surfaces of the lower clutch and the internal gear clutch contact each other; the coupling shaft goes through the lower clutch and one of its ends is linked to and moves along with the planetary gear of the internal gear clutch; the other end of the coupling shaft is provided with a torque tube, and the torque tube has a going-through torsion spring, and is further covered by a torque sheath.

2. The two-stage locking electric screwdriver as claimed in claim 1, wherein said motor unit further includes: a motor, an accelerator/supercharger, and the spin axis for motor power output has an accelerator/supercharger going through it.

3. The two-stage locking electric screwdriver as claimed in claim 2, wherein said motor is preferably a brushless motor.

4. The two-stage locking electric screwdriver as claimed in claim 2, wherein said accelerator/supercharger includes one or more than one bearing (or sleeve) with certain proportional weight and is made of metallic material.

5. The two-stage locking electric screwdriver as claimed in claim 1, wherein said screwdriver head unit has an inside connecting shaft, linked with and moving along with the coupling shaft inside the clutch unit; the connecting shaft has a binding cleft to fit various screwdriver heads, with three steel balls inside the cleft for clamping and positioning.

6. The two-stage locking electric screwdriver as claimed in claim 5, wherein said binding cleft can be of any geometric shape, such as round, square or polygon.

7. The two-stage locking electric screwdriver as claimed in claim 1, wherein said power source can be a rechargeable battery.

* * * * *